US008925633B2

(12) United States Patent
Nguyen

(10) Patent No.: US 8,925,633 B2
(45) Date of Patent: Jan. 6, 2015

(54) INFLOW CONTROL DEVICE WITH ADJUSTABLE ORIFICE AND PRODUCTION STRING HAVING THE SAME

(75) Inventor: Nelson P. Nguyen, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 443 days.

(21) Appl. No.: 13/350,248

(22) Filed: Jan. 13, 2012

(65) Prior Publication Data

US 2013/0180724 A1 Jul. 18, 2013

(51) Int. Cl.
*E21B 34/00* (2006.01)

(52) U.S. Cl.
USPC ..... 166/316; 166/179; 166/373

(58) Field of Classification Search
CPC ..... E21B 43/12; E21B 34/00; E21B 34/06; E21B 33/12; E21B 2034/00; E21B 43/08
USPC ..... 166/316, 179, 373, 386, 227
See application file for complete search history.

(56) References Cited

U.S. PATENT DOCUMENTS

| | | | | |
|---|---|---|---|---|
| 4,782,896 | A * | 11/1988 | Witten | 166/116 |
| 7,559,375 | B2 * | 7/2009 | Dybevik et al. | 166/316 |
| 8,607,873 | B2 * | 12/2013 | Aadnoy | 166/320 |
| 2006/0118296 | A1 | 6/2006 | Dybevik et al. | |
| 2006/0131033 | A1 | 6/2006 | Bode et al. | |
| 2009/0000787 | A1 | 1/2009 | Hill et al. | |
| 2011/0073308 | A1 * | 3/2011 | Assal et al. | 166/278 |
| 2011/0247813 | A1 | 10/2011 | Moen | |
| 2013/0037275 | A1 * | 2/2013 | Noui-Mehidi | 166/386 |
| 2013/0037276 | A1 * | 2/2013 | Kuo et al. | 166/386 |
| 2013/0068467 | A1 * | 3/2013 | Zhou | 166/369 |

OTHER PUBLICATIONS

International Search Report and Written Opinion; Date of Mailing Mar. 28, 2013; Korean Intellectual Property Office; International Search Report 5 pages; Written Opinion 6 pages.

Ayesha Al Marzooqi, Hamdy Helmy, Ashraf Keshka, "Wellbore Segmentation Using Inflow Control Devices: Design and Optimisation Process" paper prepared for presentation at the Abu Dhabi International Petroleum Exhibition & Conference, Abu Dhabi, UAW, Nov. 1-4, 2010, SPE 137992, Society of Petroleum Engineers, pp. 1-12.

Ivan Vela, Lumay Viloria-Gomez, Ricardo Caicedo and Francisco Porturas, "Well Production Enhancement Results with Inflow Control Device (ICD) Completions in Horizontal Wells in Ecuador" paper prepared for presentation at the SPE EUROPEC/EAGE Annual Conference and Exhibition held in Vienna, Austria, May 23-26, 2011, SPE 143431, Society of Petroleum Engineers, pp. 1-15.

* cited by examiner

*Primary Examiner* — Yong-Suk (Philip) Ro
(74) *Attorney, Agent, or Firm* — Cantor Colburn LLP

(57) ABSTRACT

An inflow control device laterally insertable in a wall of a tubular, the inflow control device includes a plug shaped body having a first section and a second section, the first section having an orifice accessible to an interior of the tubular and the second section having an opening accessible to an exterior of the tubular, the orifice in fluid communication with the opening; and a selectable insert insertable into the orifice, the insert having an inner periphery providing a flow path between the exterior and interior of the tubular. Also, included is a production string and adjustable orifice inflow control device combination.

20 Claims, 2 Drawing Sheets

INFLOW CONTROL DEVICE WITH ADJUSTABLE ORIFICE AND PRODUCTION STRING HAVING THE SAME

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration.

To balance inflow of fluids into a completion string along the length of the borehole, controlling fluid flow into the completion string can be accomplished through the use of one or more inflow control devices ("ICDs"). Different zones of a formation accessed by a borehole may produce at different rates, particularly in horizontal wells that have issues with the heel-toe effect. The pressure within the completion string increases in the upstream direction, and therefore the differential pressure between an exterior and an interior of the completion string will vary along the length of the completion string unless controlled or otherwise adjusted. ICDs can be used with a completion string to reduce production from high producing zones, such as near the heel, thus stimulating production from low or non-producing zones, such as near the toe. When an evenly distributed flow profile is realized, water or gas coning can be reduced.

The structure and function of ICDs generally feature a dual-walled tubular housing surrounding a production tubing with one or more inflow passages laterally disposed through the inner wall of the housing. A sand screen surrounds a portion of the tubular housing. Production fluid will enter the sand screen and then must negotiate a tortuous pathway (such as a spiral pathway) between the dual walls to reach the inflow passage. The tortuous pathway slows the rate of flow and maintains it in an even manner. Some inflow control devices further provide means for selectively or automatically closing off flow into the production tubing in the event that water and/or gas invades the production layer.

The art would be receptive to alternative devices and methods for inflow control.

BRIEF DESCRIPTION

An inflow control device laterally insertable in a wall of a tubular, the inflow control device includes a plug shaped body having a first section and a second section, the first section having an orifice accessible to an interior of the tubular and the second section having an opening accessible to an exterior of the tubular, the orifice in fluid communication with the opening; and a selectable insert insertable into the orifice, the insert having an inner periphery providing a flow path between the exterior and interior of the tubular.

A production string and adjustable orifice inflow control device combination, the combination includes a downhole tubular having a wall, the wall having a laterally disposed first aperture therethrough; an inflow control device including: a plug shaped body having a first section and a second section, the first section inserted into the first aperture and having an orifice accessible to an interior of the tubular and the second section having an opening accessible to an exterior of the tubular, the orifice in fluid communication with the opening; and a selectable insert insertable into the orifice, the insert having an inner periphery providing a flow path between the exterior and interior of the tubular.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
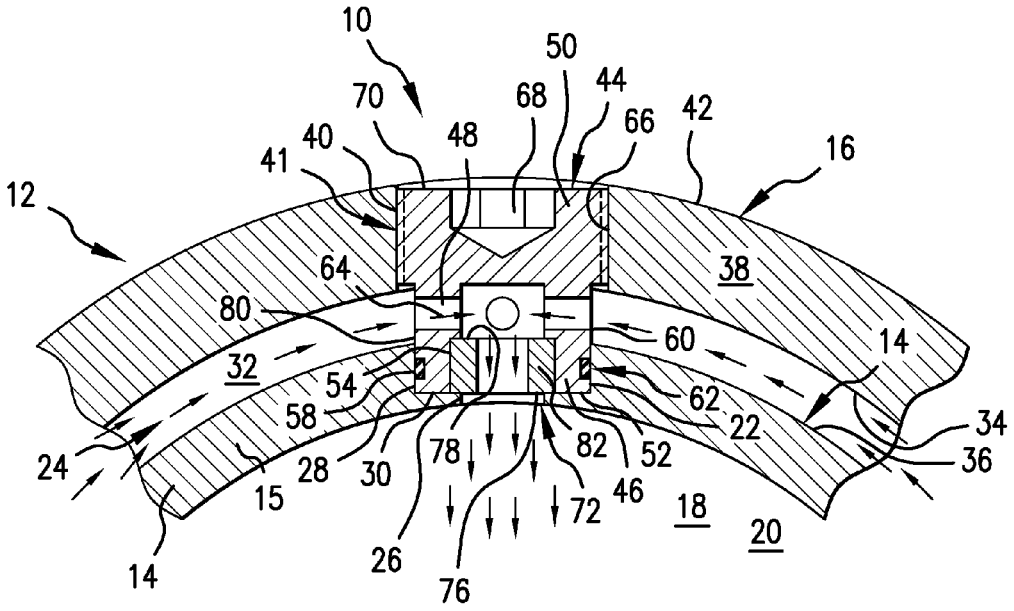
FIG. 1 depicts a cross sectional view of an exemplary embodiment of an adjustable orifice inflow control device ("ICD") installed in a production string.

An exemplary embodiment of an adjustable orifice inflow control device ("ICD") 10 is shown in FIG. 1. The ICD 10 is inserted within a production string 12, more fully shown in FIG. 3, which includes a downhole tubular 14, such as a production pipe, and a housing 16.

The downhole tubular 14 is sized for receiving production fluid and directing it to surface along a longitudinal flowbore 18. The tubular 14 is also usable to pass fluids from the surface in a downstream direction. The flowbore 18 is within an interior 20 of the tubular 14. The tubular 14 includes a laterally disposed first aperture 22, penetrating a wall 15 of the tubular 14, which provides a passage into the flowbore 18 and provides communication between the interior 20 of the tubular 14 and an exterior 24 of the tubular 14. In the illustrated embodiment, the first aperture 22 includes a first inner diameter 26 directing production fluid into the interior 20 of the tubular 14, and a second inner diameter 28 sized to receive a portion of the ICD 10. The portion of the first aperture 22 having the first inner diameter 26 is closer (more radially inward) to the interior 20 of the tubular 14 than the portion of the first aperture 22 having the second inner diameter 28. As shown, the first inner diameter 26 is smaller than the second inner diameter 28, and a ledge 30 is formed between the first and second inner diameters 26, 28.

The housing 16 is arranged outside of the tubular 14. The housing 16 may be substantially concentrically arranged about the downhole tubular 14, may have a different longitudinal axis than the tubular 14, or the housing 16 may only partially surround the tubular 14. Although FIG. 3 depicts housing 108 to accommodate ICD 100 of FIG. 2, it should be understood that housing 16 may similarly surround the tubular 14 shown in FIG. 3. In any case, the housing 16 is spaced from the exterior 24 of the tubular 14 to form a production pathway 32 between an interior surface 34 of the housing 16 and an exterior surface 36 of the tubular 14. The production pathway 32 is an annulus when the housing 16 completely surrounds the tubular 14. The production pathway 32 provides a pathway from an opening 124 (shown in FIG. 3 in the housing 108) to the ICD 10, 100. The production pathway 32 includes a path, such as, but not limited to, a spiral pathway, a tortuous pathway, a longitudinally arranged pathway, an annular pathway, and a direct pathway from the opening in the housing 16 to the ICD 10. A sand screen 126, or other debris filter screen, (shown in FIG. 3) is incorporated to prevent debris such as sand from entering the pathway 32. In the illustrated embodiment, the sand screen 126 is partially surrounded by a weld ring 128 which is welded at weld areas 130 to the housing 108 such that only flow entering the inlet 132 may enter the pathway 32. The housing 108 may be additionally welded at weld areas 134 along a downstream location of the tubular 14. Other or additional sealing devices may be included to protect the incoming flow from debris.

With reference again to FIG. 1, the wall 38 of the housing 16 includes a laterally disposed second aperture 40 that extends through the wall 38 from an exterior surface 42 of the housing 16 to the interior surface 34 of the housing 16. In the illustrated embodiment, a longitudinal axis of the second aperture 40 is aligned with a longitudinal axis of the first aperture 22. In this exemplary embodiment, the second aperture 40 includes threads 41.

The ICD 10 includes a plug shaped body 44. In an exemplary embodiment, the body 44 is a one piece integral unit. When the ICD 10 is inserted in the production string 12, a first section 46 of the body 44 is disposed in the second inner diameter 28 of the first aperture 22 of the tubular 14, a second section 48 of the body 44 is disposed in the production pathway 32, and a third section 50 of the body 44 is disposed in the second aperture 40 of the housing 16. The first section 46 of the body 44 includes a first end surface 52 and an orifice 54 that passes through the first end surface 52 and is accessible to the flowbore 18 of the tubular 14 when the ICD 10 is installed in the production string 12. In the illustrated embodiment, the first section 46 also include a groove 58, such as a circumferential groove, along an exterior surface 60 of the body 44. The groove 58 receives a seal 62, such as an O-ring to seal the body 44 relative to the tubular 14. The second section 48 of the body includes at least one opening 64 that connects the production pathway 32 to the orifice 54. The opening 64 is substantially perpendicularly arranged with respect to the orifice 54. As illustrated in FIG. 1, the second section 48 of the body 44 includes a first, second, and third openings 64, however it should be understood that alternate numbers of openings 64 can be incorporated within the second section 48 of the body 44. The third section 50 of the body 44 includes threads 66 on the exterior surface 60 that cooperate with threads 41 of the second aperture 40 of the housing 16. The third section 50 of the body 44 also includes a tool receiving indentation 68 on a second end surface 70 of the body 44. The tool receiving indentation 68 has a shape sized to fit a head of a plug insertion tool (not shown), such as, but not limited to, the head of a screwdriver, allen wrench, etc. The third section 50 of the body 44 is not perforated through to the second section 48 of the body 44, so that once the body 44 is inserted into the production string 12, flow is not permitted via the second aperture 40 from an exterior of the housing 16 to the pathway 32 or second section 48 of the body 44.

When the ICD 10 is inserted into the production string 12 as shown in FIG. 1, flow from the pathway 32 at a first pressure enters the body 44 through the openings 64 in the second section 48 of the body 44 and is directed through the orifice 54 in the first section 46 of the body 44 so that the flow from the pathway 32 exits into the tubular 14. In order to adjust the pressure of the flow from the pathway 32 to the tubular 14, an insert 72, having an inner diameter smaller than the inner diameter of the orifice 54, is inserted into the orifice 54. The insert 72 may be made of various materials including, but not limited to, carbide, ceramic, etc. In an exemplary embodiment, prior to installing the body 44 into the first and second apertures 22, 40, the insert 72 is inserted into the orifice 54 such that a first end 76 of the insert 72 is substantially aligned with the first end surface 52 of the body 44, and a second end 78 of the insert 72 abuts against a shoulder 80 of the first section 46 of the body 44. Thus, a length of the insert 72 substantially matches a distance from the first end surface 52 of the body 44 to the shoulder 80. When the body 44 and insert 72 combination is then installed into the first and second apertures 22, 40, the first end surface 52 of the body 44 and at least a portion of the first end 76 of the insert 72 abut against the ledge 30 in the first aperture 22 so that the insert 72 is securely retained within the body 44. Alternatively, the insert 72 may be adhered within the body 44. In yet another exemplary embodiment, the insert 72 and the body 44 may include cooperating retaining features for retaining the insert 72 within the body 44.

In one exemplary embodiment, the insert 72 includes a tubular shaped wall 82 having a thickness with an outer diameter substantially matching the inner diameter of the orifice 54 and an inner diameter chosen to vary the flow pressure into the tubular 14. The outer diameter of the wall 82 of the insert 72 and inner diameter of the orifice 54 need not be limited to circular shapes, and may include any corresponding shape for the insert 72 to nest within the body 44. A set of inserts 72 may be provided having varying inner diameters so that an operator can select the inner diameter that would correspond to the desired pressure change. The plug shaped body 44 remains the same for an insert 72 having any inner diameter, making the ICD 10 a cost effective choice for inflow control. The inner diameter of the insert 72 is not limited to a circular shape, as other inner peripheral shapes can also be incorporated within the insert 72. The insert 72 may be preassembled with the body 44, or may easily be assembled on site by an operator. The ICD 10 may also be disassembled and changed as needed.

Figure 2:
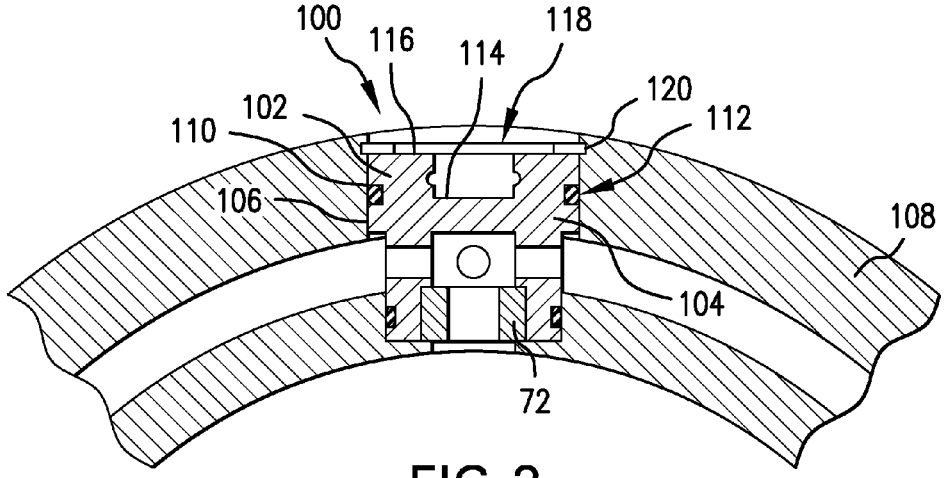
FIG. 2 depicts a cross sectional view of another exemplary embodiment of an adjustable orifice ICD installed in a production string; and, FIG. 3 depicts a cross-sectional view of a production string with the adjustable orifice ICD of FIG. 2 installed thereon.
Figure 3:
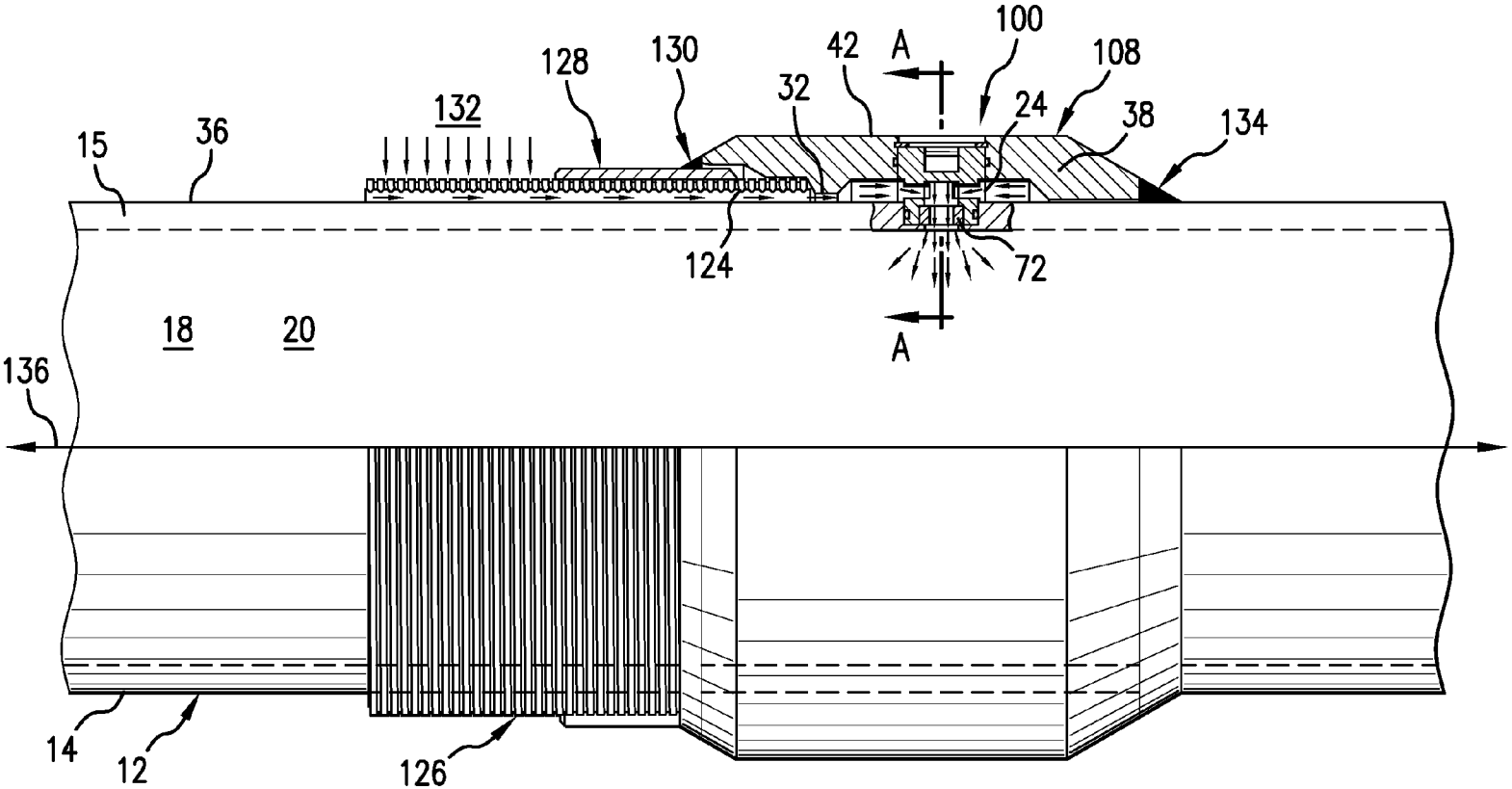

With reference to FIG. 2, an alternative exemplary embodiment of an adjustable orifice ICD 100 is shown. In this embodiment, the third section 102 of the body 104 of the ICD 100 does not include threads 66 as in the body 44 of FIG. 1, and the second aperture 106 of the housing 108 is not threaded. Instead, the third section 102 of the body 104 includes a groove 110 supporting a seal 112, such as an O-ring. A tool receiving indentation 114 is provided in the second end surface 116 of the body 104 adjacent the third section 102. A retainer ring 118 is seated on the second end surface 116 of the body 104 and within an indentation 120 in the housing 108. Other than a manner of retaining the ICD 100 within the housing 108, the ICD 100 of FIG. 2 is assembled with the insert 72 and operates in a same manner as the ICD 10 of FIG. 1.

A production string 12 is provided with any number of first and second aligned apertures 22 and 40 or 106 along a length thereof. Should the differential pressure require adjustment at a certain point along the length of the string 12, an ICD 10 or 100 having an insert 72 with a preselected inner diameter can be inserted at that point along the length as previously described. If the differential pressure does not require adjustment, then the first aperture 22 could be left empty and the second aperture 40, 106 could be plugged to provide a direct passageway from the pathway 32 to the flowbore 18, or an ICD 10 or 100 with no insert 72 could be inserted in the first 22 and second 40, 106 apertures. Also, if production from a certain zone is not desired, a solid insert 72 having no perforations therethrough could be inserted in the orifice 54 of the ICD 10, 100. All of these combinations could be accomplished on site prior to running the production string 12 downhole. Thus, an adjustable orifice ICD 10, 100 that is simple to manufacture, as well as assemble and disassemble, is provided.

While FIG. 3 depicts the ICD 100 and housing 108, it should be understood that the housing 16 and ICD 10 are similarly accommodated on the tubular 14, with the only difference being how the ICD 10, 100 is retained within the housing 16, 108, respectively. While the string 12 was depicted in FIGS. 1 and 2 as a cross-sectional view taken perpendicular to a longitudinal axis 136 (FIG. 3) of the tubular 14, FIG. 3 shows a partial cutaway view of the string 12 taken along the longitudinal axis 136 of tubular 14. As shown in FIG. 3, the housing 108 partially encloses the sand screen 126, and the opening 124 of the housing 108 is sealed by weld ring 128 and at weld areas 130, 134. The production pathway 32 may have varying outer diameters, as determined by varying inner diameters of the housing 108, to appropriately direct the flow into the ICD 10, 100.

A method of controlling a differential pressure is also made possible using the adjustable orifice ICD 10, 100. An insert 72 having an inner periphery that adjusts the differential pressure between the exterior and interior of the tubular 14 for a particular location along the string 12 is selected and inserted into the ICD 10, 100. Then, the first section 46 of the ICD 10, 100 is inserted into the first aperture 22 of the tubular 14, while the second section 48 is aligned within the production pathway 32, and the third section 50, 102 is secured into the second aperture 106 of housing 16, 108. The insertion can be accomplished by using a plug insertion tool. When the first end surface 52 of the body 44, 104 abuts the ledge 30, the ICD 10, 100 is fully inserted. By selecting an appropriate inner periphery or inner diameter of the insert 72, the differential pressure is adjusted to a desired level for each location along the length of the string 12. The ICD 10, 100 is accessible from an exterior of the housing 16, 108, thus providing easy access thereto in the event an insert 72 is to be changed.

The ICD 10, 100 described herein is usable in downhole flowing systems, as they enable the delay of flowing of one fluid from another fluid in a multiphase flow system through a pressure difference from an inlet and outlet of the system. The ICD 10, 100 are applicable in many types of downhole conditions ranging from complex to simple designs. The ICD 10, 100 is simple to manufacture, and easy to install and disassemble. Pressure drop can be adjusted at a well site if necessary. The ICD 10, 100 need not incorporate the use of a filter screen or spring which may malfunction in a debris or sand environment. The adjustable orifice ICD 10, 100 allows flow to balance in a heterogeneous reservoir and is highly resistant to erosion and corrosion damage.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An inflow control device laterally insertable in a wall of a tubular, the inflow control device comprising:

a plug shaped body having a first section, a second section, and a third section, the first section having an orifice accessible to an interior of the tubular, the second section having an opening accessible to an exterior of the tubular, the orifice in fluid communication with the opening, the second section interposed between the first and third sections, the third section securable to a housing positioned exteriorly of the tubular, and fluid communication from the opening and the orifice not permissible through the third section; and a selectable insert insertable into the orifice, the insert having an inner periphery providing a flow path between the exterior and interior of the tubular.

2. The inflow control device of claim 1, wherein the insert is formed from carbide or ceramic.

3. The inflow control device of claim 1, wherein the body is a one piece integral unit.

4. The inflow control device of claim 1, wherein the third section includes a threaded exterior threadable in a laterally disposed aperture extending from an interior surface to an exterior surface through a wall of the housing.

5. The inflow control device of claim 1, further comprising a retaining ring positioned on an end surface of the body adjacent the third section.

6. The inflow control device of claim 1, wherein the third section is not perforated through to the second section of the body.

7. The inflow control device of claim 1, wherein the housing and wall of the tubular enclose a production pathway, and the opening in the second section accesses the production pathway.

8. The inflow control device of claim 1, further comprising a seal positionable between the body and the tubular wall.

9. The inflow control device of claim 8, wherein the body includes a circumferential groove holding the seal.

10. The inflow control device of claim 1, wherein the body includes a first end surface facing the interior of the tubular and an opposite second end surface, the second end having an indentation sized to receive an insertion tool.

11. The inflow control device of claim 1, wherein a longitudinal axis of the opening is substantially perpendicular to a longitudinal axis of the orifice.

12. The inflow control device of claim 11, further comprising a plurality of openings in the second section, each opening substantially perpendicular to the orifice and in fluid communication with the orifice.

13. The inflow control device of claim 1, wherein the insert has a first end substantially aligned with a first end surface of the body and a second end abutting a shoulder within the first section.

14. The inflow control device of claim 1, further comprising a plurality of inserts each insertable within the orifice and each having a differently sized inner periphery.

15. A production string and adjustable orifice inflow control device combination, the combination comprising:

a downhole tubular having a wall, the wall having a laterally disposed first aperture therethrough;

an inflow control device including:

a plug shaped body having a first section and a second section, the first section inserted into the first aperture and having an orifice accessible to an interior of the tubular and the second section having an opening accessible to an exterior of the tubular, the orifice in fluid communication with the opening; and a selectable insert insertable into the orifice, the insert having an inner periphery providing a flow path between the exterior and interior of the tubular.

16. The production string and adjustable orifice inflow control device combination of claim 15, further comprising a housing positioned exteriorly of the tubular, the housing including a second aperture and the body of the inflow control device including a third section securable within the second aperture.

17. The production string and adjustable orifice inflow control device combination of claim 16, further comprising a production pathway between the housing and the tubular, wherein the opening in the second section is in fluid communication with the production pathway.

18. The production string and adjustable orifice inflow control device combination of claim 17 further comprising a plurality of first apertures in the wall of the tubular, corresponding second apertures in the housing, bodies of the inflow control devices inserted within the first and second apertures, and inserts inserted within each of the bodies, wherein the inner periphery of each insert is selectable based on downhole position of the production string to vary a pressure exiting the insert into the tubular.

19. The production string and adjustable orifice inflow control device combination of claim 15, wherein the inner periphery of the insert is selected to vary a pressure differential between an interior and exterior of the tubular.

20. The production string and adjustable orifice inflow control device combination of claim 15, wherein the inflow control device is insertable and removable from the tubular and accessible from an exterior of the housing, and the insert is interchangeable within the body with other inserts having variously sized inner peripheries.

* * * * *